US005497634A

United States Patent [19]

Kojima et al.

[11] Patent Number: 5,497,634

[45] Date of Patent: Mar. 12, 1996

[54] REFRIGERATOR WITH HEAT EXCHANGER OPTIMALLY CONFIGURED

[75] Inventors: Takao Kojima, Kanagawa; Minoru Temmyo, Osaka; Takuya Kishimoto, Kanagawa, all of Japan

[73] Assignee: Kabushiki Kaisha Toshiba, Kawasaki, Japan

[21] Appl. No.: 197,973

[22] Filed: Feb. 17, 1994

[30] Foreign Application Priority Data

Feb. 26, 1993 [JP] Japan ..... 5-037219

[51] Int. Cl.[6] ..... F25D 11/02

[52] U.S. Cl. ..... 62/441; 62/452

[58] Field of Search ..... 62/441, 452, 404, 62/406, 452, 451, 454, 455, 335

[56] References Cited

U.S. PATENT DOCUMENTS 3,375,677 4/1968 Bright et al. .

4,211,090 7/1980 Gelbard et al. ..... 62/441

FOREIGN PATENT DOCUMENTS 0478122 4/1992 European Pat. Off. .

*Primary Examiner*—John M. Sollecito

*Attorney, Agent, or Firm*—Foley & Lardner

[57] ABSTRACT

A refrigerator with heat exchanger optimally configured to conserve electricity and improve a food storing capability at its best state. The refrigerator includes: a freezing room connected from an evaporator through a circulating passage, the freezing room having the circulating passage which circulates an air cooled by the evaporator; a storage room connected to the freezing room, in which a temperature of the storage room is set higher than that of the freezing room; a flow-in passage connected to the storage room where the air cooled by the evaporator flows into the storage room; a flow-out passage connected from the storage room where a chilled air flows out of the storage room; and a heat exchanger for exchanging heat between the cooled air flowing through the circulating passage and the chilled air flowing through the flow-out passage, so that the temperature inside the storage room is evenly and smoothly stable.

2 Claims, 8 Drawing Sheets

REFRIGERATOR WITH HEAT EXCHANGER OPTIMALLY CONFIGURED

BACKGROUND OF THE INVENTION

1. Technical Field

The present invention relates to a construction of a cooled-air circulating passage directed toward a fresh room in a refrigerator having a freezing room and the fresh room (refrigerating room) therein.

2. Background Art

FIG. 1 is a schematic diagram showing a construction of the conventional refrigerator.

Referring to FIG. 1, the conventional refrigerator consists of an evaporator 1, a duct 3, a freezing room 5, a fresh room 7, a vegetable room 9 and a damper 11. The temperature of the evaporator 1 is set below the temperature of the freezing room 5. High-temperature air is cooled by a compressor and a fan (not shown), so that the cooled air is distributed to the freezing room 5 and the fresh room 7. The air output from each room is returned to the evaporator 1 through the duct 3 and is again cooled by the evaporator 1.

The fresh room 7 and the vegetable room 9 are cooled in a manner that the cooling degree is controlled by an opening-closing of the damper 11. The cooled air flows through the fresh room 7 and the vegetable room in this order. The flow directions of the air are shown by arrow marks in FIG. 1.

Note that the freezing room 5 has the lowest temperature, the fresh room 7 has a temperature that is slightly higher than the freezing room 5, and the vegetable room 9 has a temperature that is slightly higher than the fresh room 7.

FIG. 2 is a timing chart showing the timing and duration of operating elements according to the refrigerator shown in FIG. 1.

FIG. 2, shows the temperature of the evaporator 1 with the compressor and fan being activated and not activated, the state (open or close) of the damper 11 of fresh room 7, the temperature in the fresh room 7 and the temperature of the cooled air blowing into the fresh room 7.

Referring to FIGS. 1 and 2, when the compressor and the fan are switched ON, the temperature of the evaporator 1 is decreased. Then, the damper 11 is opened before the compressor and the fan are operated ON. Thus, the cooled air enters into the fresh room 7. Thereafter, when the fresh room 7 is sufficiently cooled, the damper 11 is closed so that the cooled air from the evaporator 1 does not enter into the fresh room 7. In other words, by shutting off the cooled air entering the fresh room 7, the temperature of the fresh room 7 is controlled.

However, in the conventional refrigerator, there are the following problems:

(1) The cooled air for cooling the fresh room 7 has the same temperature with the cooled air for cooling the freezing room 5. Thus, the passage for the cooled air to pass through the fresh room 7 is controlled by opening and closing the passage, in order that the the temperature of the fresh room 7 is kept at a suitable temperature. As a result thereof, the temperatures in the refrigerator, especially the fresh room 7 fluctuates with a undesirably big range, in other words, difference between the maximum and minimum temperatures of the fresh room 7 is greater than a too much to suitable amount. Moreover, there occurs different temperature distribution inside the fresh room.

(2) Since the temperature of the cooled air blowing into the fresh room is too low, so that the food placed near a blowout opening tends to be frozen.

(3) The circulated air from each room is returned to the evaporator 1 through each different passage. Therefore, each returned air has its own different state, thus creating undesirable dispersion of conditions when each circulated air is returned to the evaporator 1. As a result, the efficiency for the evaporator 1 is deteriorated and a heat exchanging portion is frosted.

As described above, in the conventional refrigerators, the temperature inside the refrigerator especially the fresh room fluctuates undesirably, and the food placed near the cooled-air blowout opening is undesirably frozen, Moreover, the evaporator efficiency is deteriorated and the heat exchanging portion becomes frosted.

SUMMARY OF THE INVENTION

In view of the foregoing drawbacks, it is therefore an object of the present invention to provide a refrigerator in which an electricity-saving operation and an improved food storage capability are realized by smoothing the temperature inside the refrigerator. Moreover, the object of the invention includes to improve the efficiency of heat exchanging and to prevent a heat-exchanging portion from being frosted.

To achieve the object, there is provided a refrigerator including an evaporator therein, the refrigerator comprising: a freezing room connected from the evaporator through a circulating passage, the freezing room having the circulating passage which circulates an air cooled by the evaporator; a storage room connected to the freezing room, in which a temperature of the storage room is set higher than that of the freezing room; a flow-in passage connected to the storage room where the air cooled by the evaporator flows into the storage room; a flow-out passage connected from the storage room where a chilled air flows out of the storage room; and heat exchanging means for exchanging heat between the cooled air flowing through the circulating passage and the chilled air flowing through the flow-out passage.

BRIEF DESCRIPTION OF THE DRAWINGS

These and other objects, features and advantages of the present invention will become more apparent from the following description of the preferred embodiment taken in conjunction with the accompanying drawings, in which.

DETAILED DESCRIPTION OF THE PREFERRED EMBODIMENTS

Features of the present invention will become apparent in the course of the following description of exemplary embodiments which are given for illustration of the invention and are not intended to be limiting thereof. Embodiments of the present invention will now be described with reference to the drawings.

Figure 3:
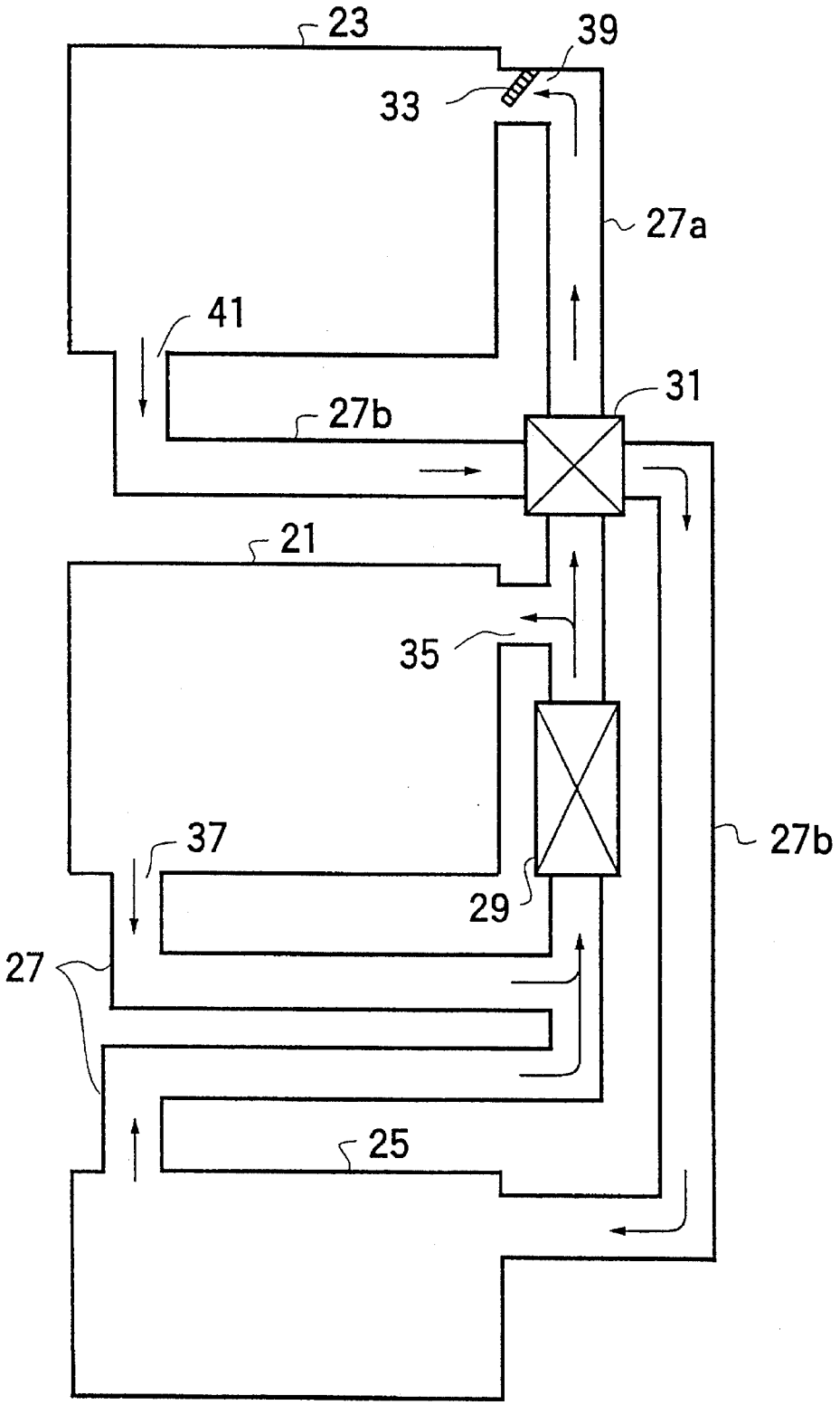
FIG. 3 is a construction diagram according to an embodiment for the present invention.

A basic configuration for a novel refrigerator is characterized in that there is provided a heat exchanging means between a cooled air flowing through a circulating passage to and from an evaporator and a chilled air flowing through a passage connected to and from a refrigerating room, as shown in FIG. 3. As will be described below, the evaporator serves to heat-exchange between a cooling cycle and an air, whereas the heat exchanging means serves to heat-exchange between an air from the refrigerating room and the air from the evaporator.

FIG. 3 is a construction diagram according to an embodiment for the present invention where a freezing room 21 is provided and disposed between a fresh room 23 and a vegetable room 25.

Referring to FIG. 3, the refrigerator comprises the freezing room 21, the fresh room 23, the vegetable room 25, ducts 27*a*, 27*b*, an evaporator 29, a heat exchanger 31 and a damper 33. Arrow marks in FIG. 3 show directions of air flow.

Next, operation for the construction configured in FIG. 3 will be described.

The temperature of cooled air transferred into the freezing room 21 by a compressor (not shown) is determined by an evaporation temperature of the evaporator 29. The cooled air generated from evaporation at the evaporator 29 is fed to inside of the freezing room 21 through a cooled-air blowout opening 35 connected to a duct 27. The cooled air freezes an object or food disposed in the freezing room 21. The cooled air that has been used for freezing the food and whose temperature is increased, is discharged from a cooled-air discharge opening 37 and is then returned to the evaporator 29.

Referring still to FIG. 3, the cooling mechanism for the fresh room 23 is as follows. There is provided a freely open-closable damper 33 in a cooled-air blowout opening 39. A cooled-air circulating passage is constituted by a cooled-air blowout duct 27*a* for receiving the intake of the cooled air from a heat exchanger 31 and for connecting to the fresh room 23, and a discharge duct 27*b* for discharging the air from the fresh room 23. Both the blowout duct 27*a* and the discharge duct 27*b* are connected to the heat exchanger 31. In other words, the cooled air fed to the fresh room 23 cools an object such as food placed in the fresh room 23 and is discharged from a discharge opening 41 through which the air is discharged from the fresh room 23.

Then, the cooled air discharged from the discharge opening 41 flows to a vegetable room 25 through the discharge duct 27*b*. Both the discharge duct 27*b* for transferring the cooled air from the fresh room 23 and the blowout duct 27*a* for transferring the cooled air evaporated at evaporator 29 are connected to the heat exchanger 31. By such a novel configuration demonstrated in FIG. 3, the cooled air blown out to the fresh room 23 and the cooled air discharged from the fresh room 23 are heat-exchanged in the heat exchanger 31. In other words, the temperature of the cooled air discharged from the fresh room is decreased; namely, the temperature of the cooled air which cools the vegetable room 25 and returns to the evaporator 29 is decreased.

In the above structure and operation for the novel refrigerator, the temperature of the cooled air blown into the fresh room 23 is increased, so that a temperature difference between the cooled air blown into the fresh room 23 and the air blown out of the fresh room 23 is desirably decreased to keep a preselected temperature of the fresh room in a stable manner. As a result, the inside of the fresh room is not rapidly cooled but gradually and smoothly cooled so as to achieve a desired cooling of the fresh room 23. Then, the duration in which is damper 33 is opened is made longer.

Figure 4:
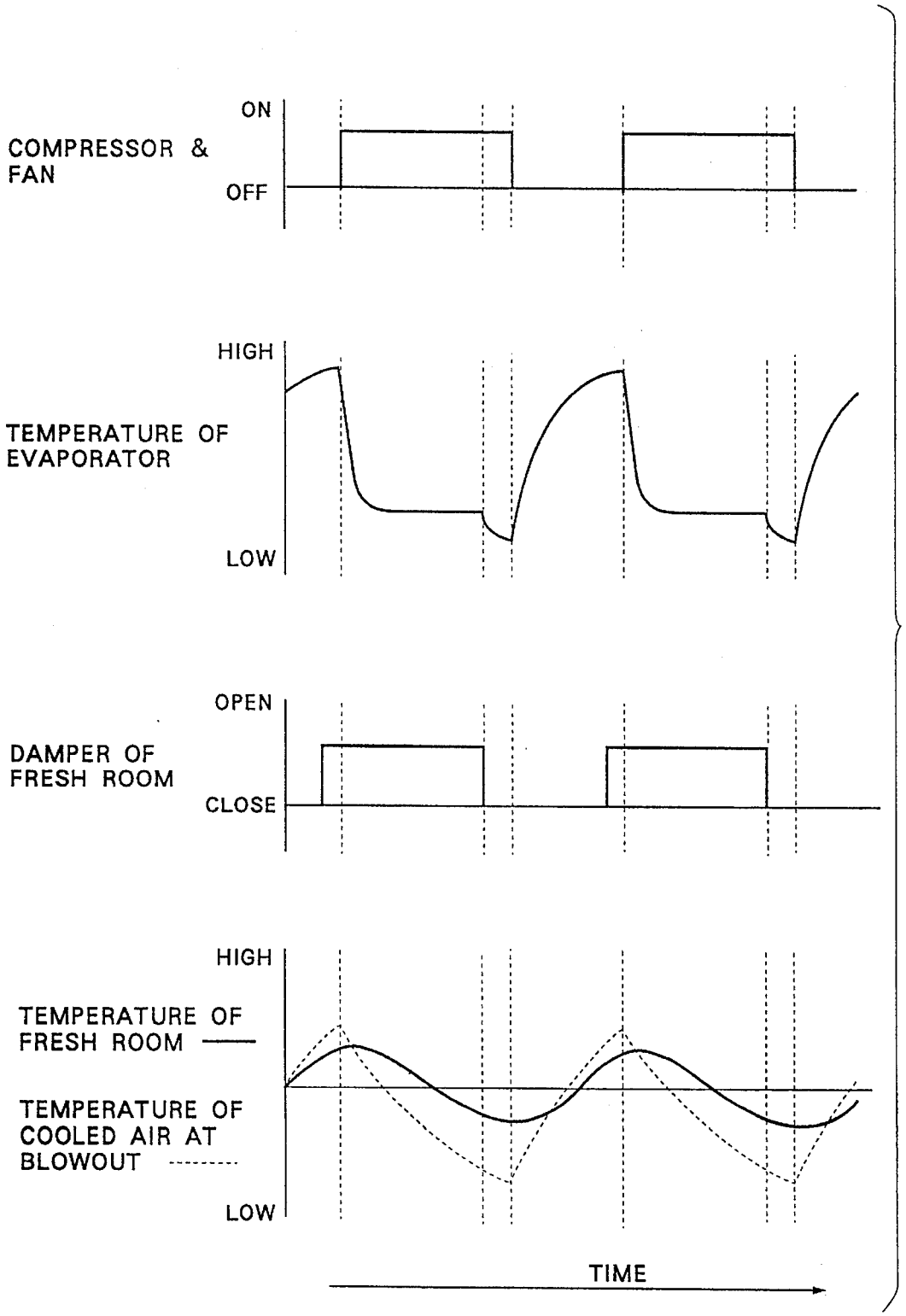
FIG. 4 is a timing diagram illustrating relation between activation (and no-activation) of the compressor and damper in terms of temperature in the fresh room.

FIG. 4 is a timing diagram illustrating relation between activation (and no-activation) of the compressor and damper in terms of temperature in the fresh room.

Figure 1:
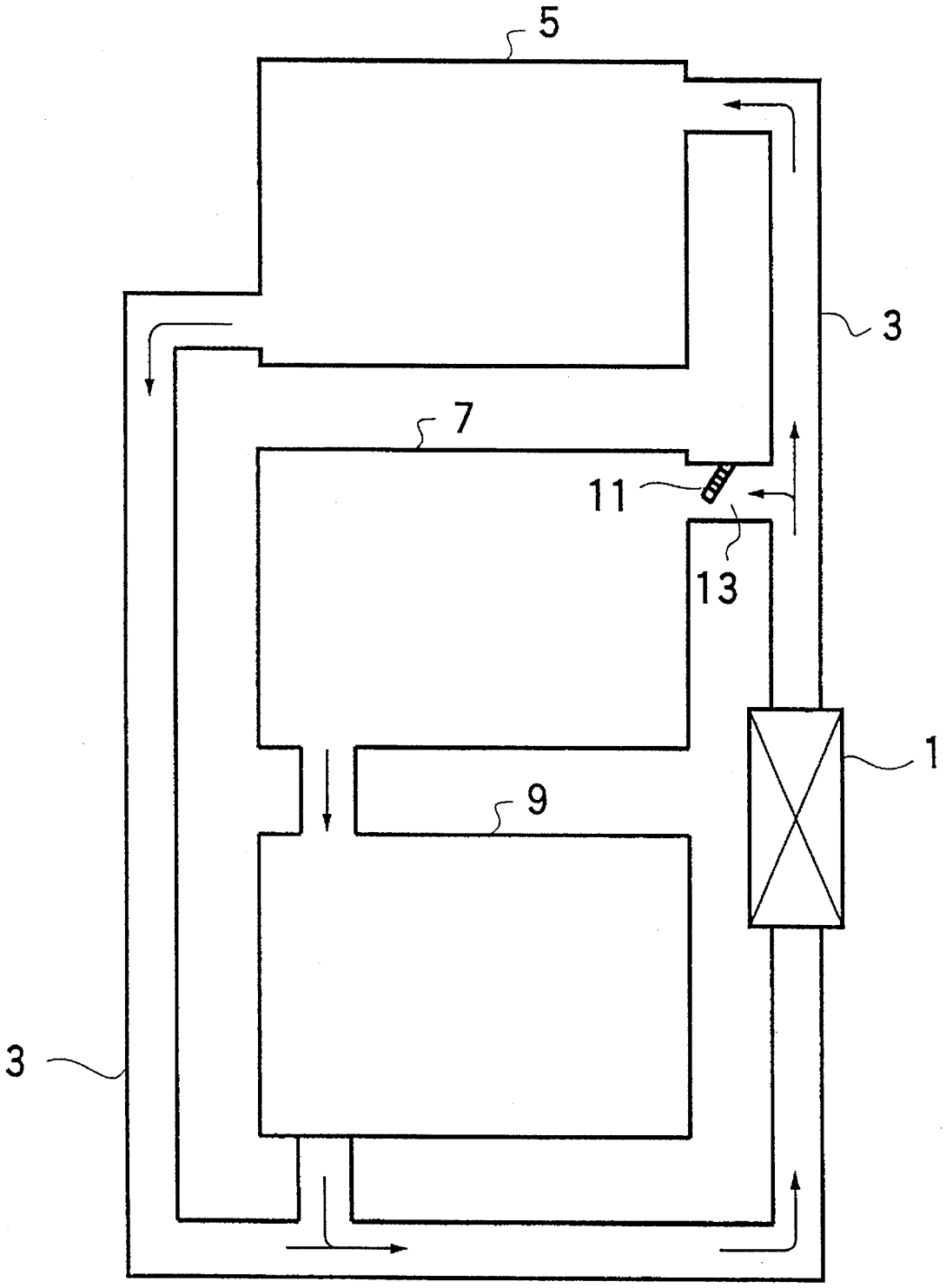
FIG. 1 is a schematic diagram showing a construction of the conventional refrigerator.
Figure 2:
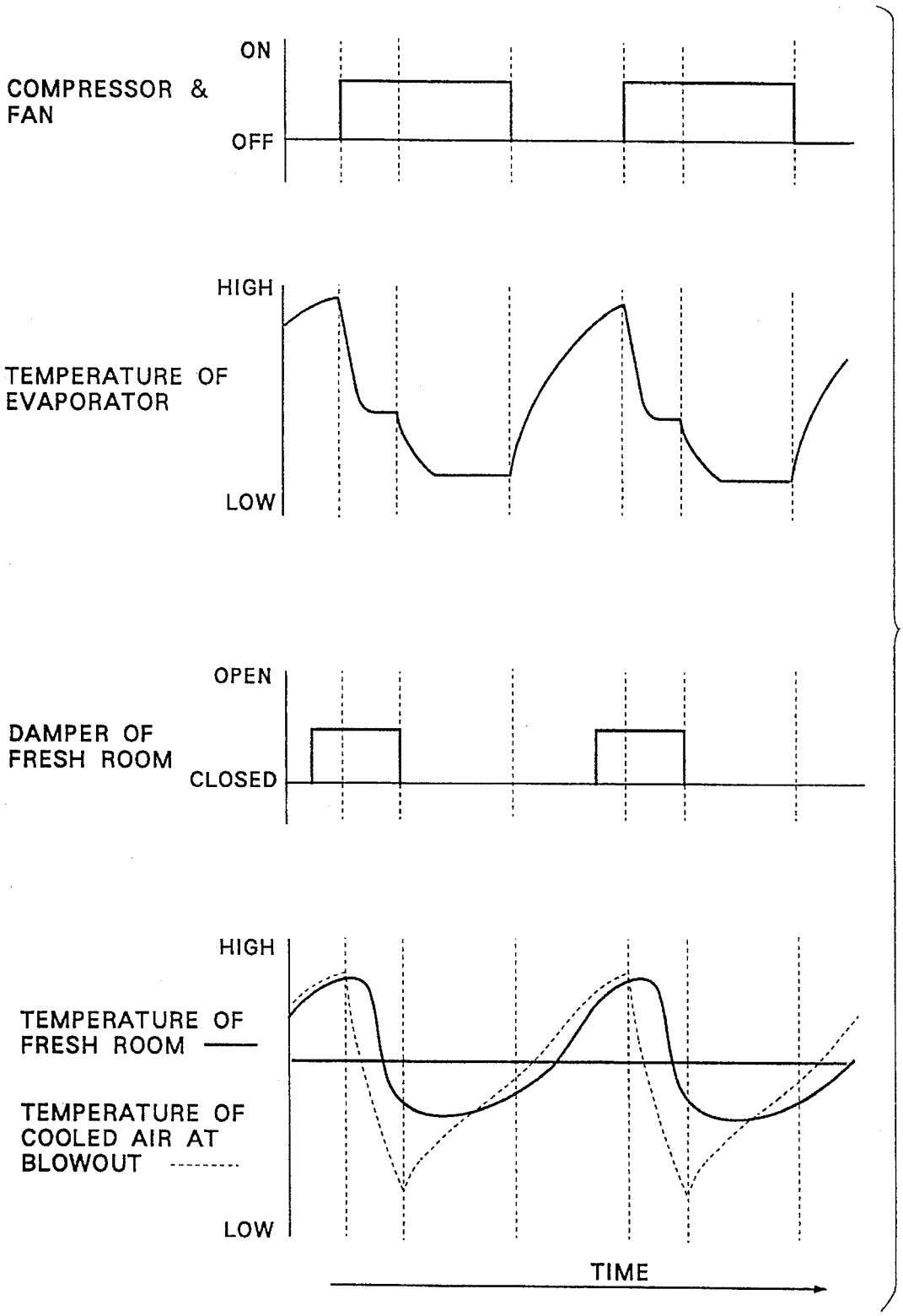
FIG. 2 PRIOR ART
FIG. 2 is a timing chart showing the timing and duration of operating elements according to the refrigerator shown in FIG. 1.

Referring to FIG. 4, in comparison to FIG. 2 representing the conventional refrigerator, the duration of a low temperature of the evaporator is longer during the operation of the compressor and the fan. The low temperature is not obtained too quickly obtained then. Thus, the open duration of the damper 33 is loner. Since the blowout air that enters into the fresh room 23 and the discharge air that blows out of the fresh room 23 are heat-exchanged, the temperature difference between the blowout temperature in the fresh room 23 and the preselected temperature of the refrigerator is minimized, so that the temperature within the fresh room 23 is optimally smoothed up.

Figure 9:
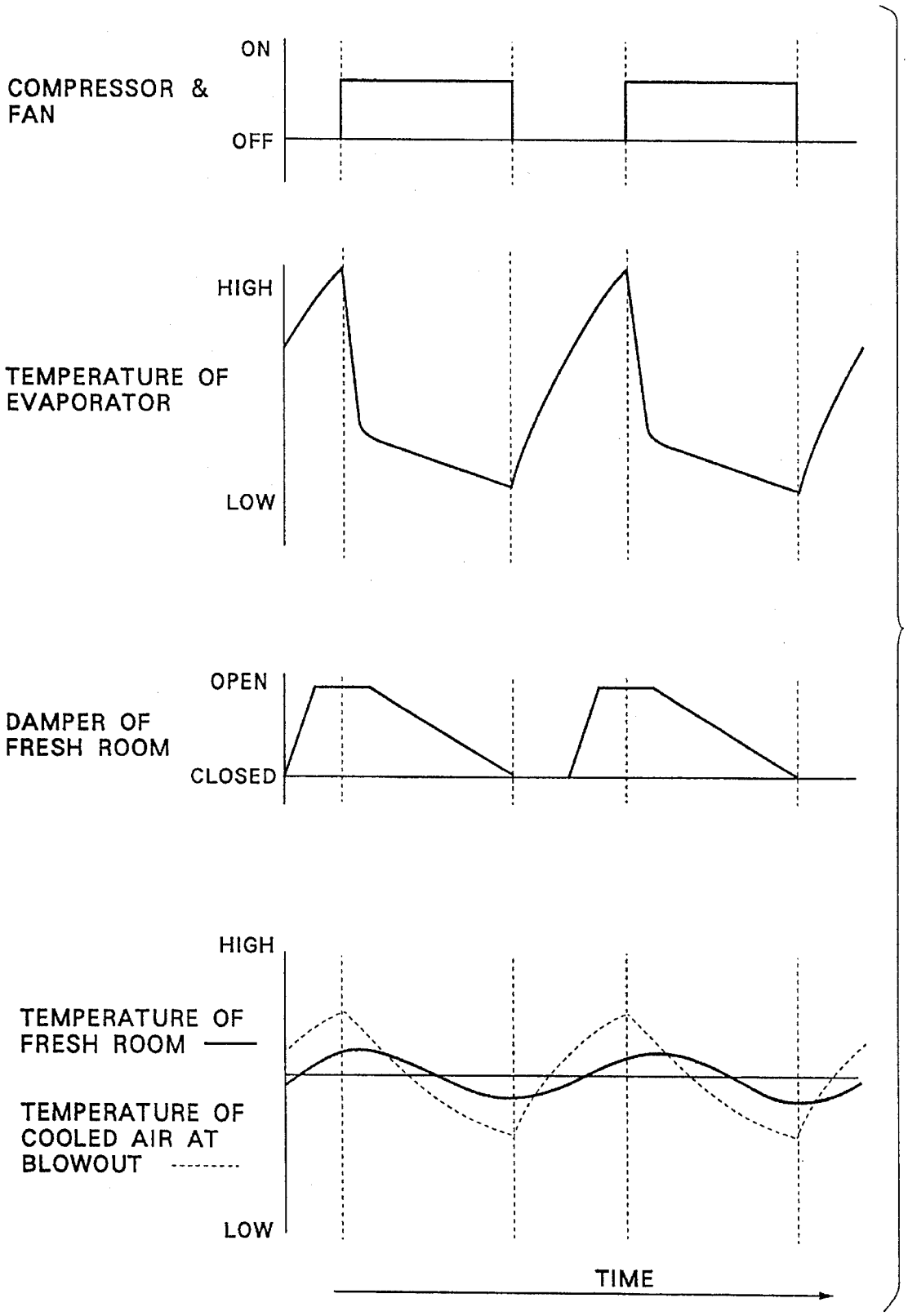
FIG. 9 is a timing diagram for a refrigerator where the damper 33 for the fresh room 23 is provided such that an openness degree of the damper 33 is continuously and steplessly controlled instead of being either open or closed.

FIG. 9 is a timing diagram for a refrigerator where the damper 33 for the fresh room 23 is provided such that an openness degree of the damper 33 is continuously controlled instead of being either open or closed. By employing such a continuously controlled damper 33, the temperature for the fresh room 23 can be further accurately controlled so as to further minimize the temperature difference between the blowout temperature in the fresh room and the preselected temperature of the refrigerator.

As described in detail above, the blowout air entering to the fresh room and the returned air blowing out of the fresh room are heat-exchanged in a passage between the fresh room and the freezing room. Thereby, the temperature of the blowout air entering to the fresh room is increased, while the returned air returning toward the evaporator is decreased, so that a load for the compressor is significantly decreased thus achieving an energy-conserving operation.

Figure 5:
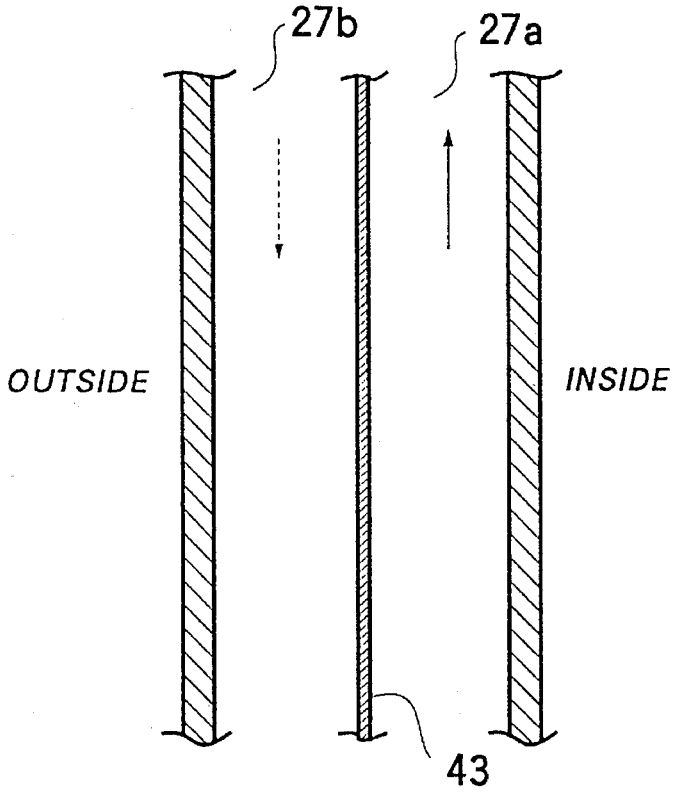
FIG. 5 illustrate another configuration example for the novel refrigerator according to the second embodiment of the present invention.

FIG. 5 illustrate another configuration example for the novel refrigerator according to the second embodiment of the present invention.

Referring to FIG. 5, the cooled-air blowout duct 27*a* for transferring the cooled-air into the fresh room 23, and the cooled-air discharge duct 27*b* for discharging the cooled-air from the fresh room 23 are disposed adjacent to each other with a heat conductive partition wall 43 interposed therebetween. The blowout duct 27*a*, the discharge duct 27*b*, the partition wall 43, and the inside of the refrigerator are arranged and configured in this order. The heat conductive partition wall 43 may be made of a thin resin material to achieve a good heat conductivity. In FIG. 5, an arrow mark of solid line designates the direction of blowout cooled air, whereas an arrow mark of dotted line is the discharged cooled air.

The reason for adopting the above configuration is to minimize a heat loss. The blowout duct 27*a* for transferring the cooled air into the fresh room 23 is preferably provided in a side of the refrigerator whose temperature is lower than outside thereof, so as to minimize the heat loss. In other words, instead of the case where the low-temperature air is discharged outside the refrigerator, the still cooled air is discharged toward inside the refrigerator so as to achieve an effective use of the cooled air.

Figure 6:
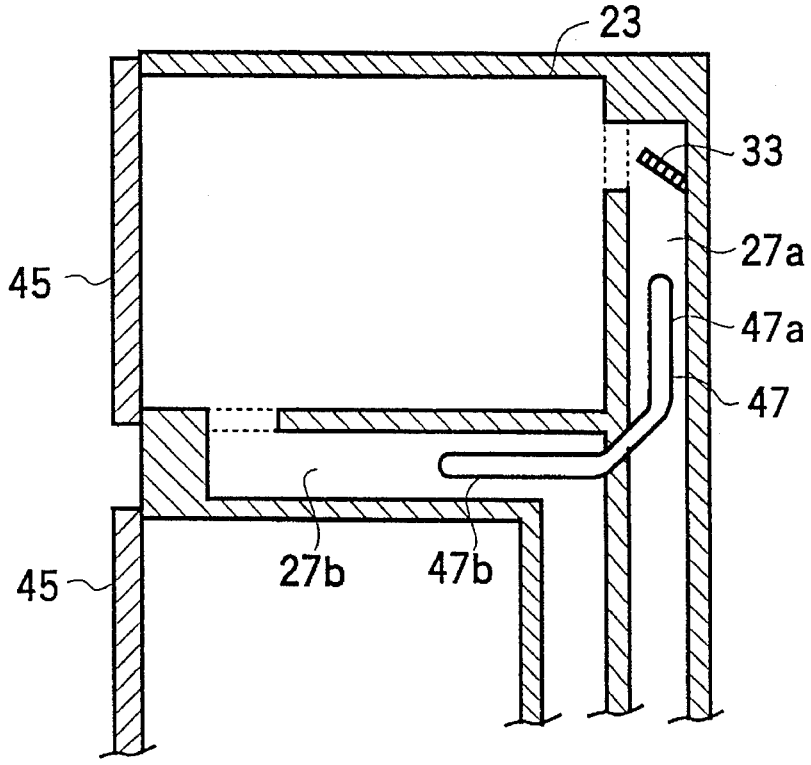
FIG. 6 is a cross sectional view of the refrigerator according to the third embodiment of the present invention.

FIG. 6 is a cross sectional view of the refrigerator according to the third embodiment of the present invention. In the same figure, the reference numeral 45 denotes a door for the storage room (fresh room 23).

Referring to FIG. 6, there is provided a heat pipe 47. The heat pipe 47 is a pipe that transferrs the heat, for example, the heat is transferred by a change of specific gravity due to a phase change of refrigerant. In FIG. 6, an end 47*a* of the heat pipe 47 is provided within the blowout duct 27*a*, and other end 47*b* is provided within the discharge duct 27*b*.

The operation for the refrigerator configured according to this second embodiment will now be described.

There contains the refrigerant inside the sealed heat pipe 47. Thereby, the refrigerant that takes away the heat in the liquid-side end 47*a*, becomes gaseous and is guided to other end 47*b*. Then, the heat is radiated in the other end 47*b* and the gaseous refrigerant becomes liquid so as to take away the heat.

In other words, in this third embodiment, the cooled air blowing to the fresh room 23 and the cooled air discharged from the fresh room are heat-exchanged efficiently.

Figure 7:
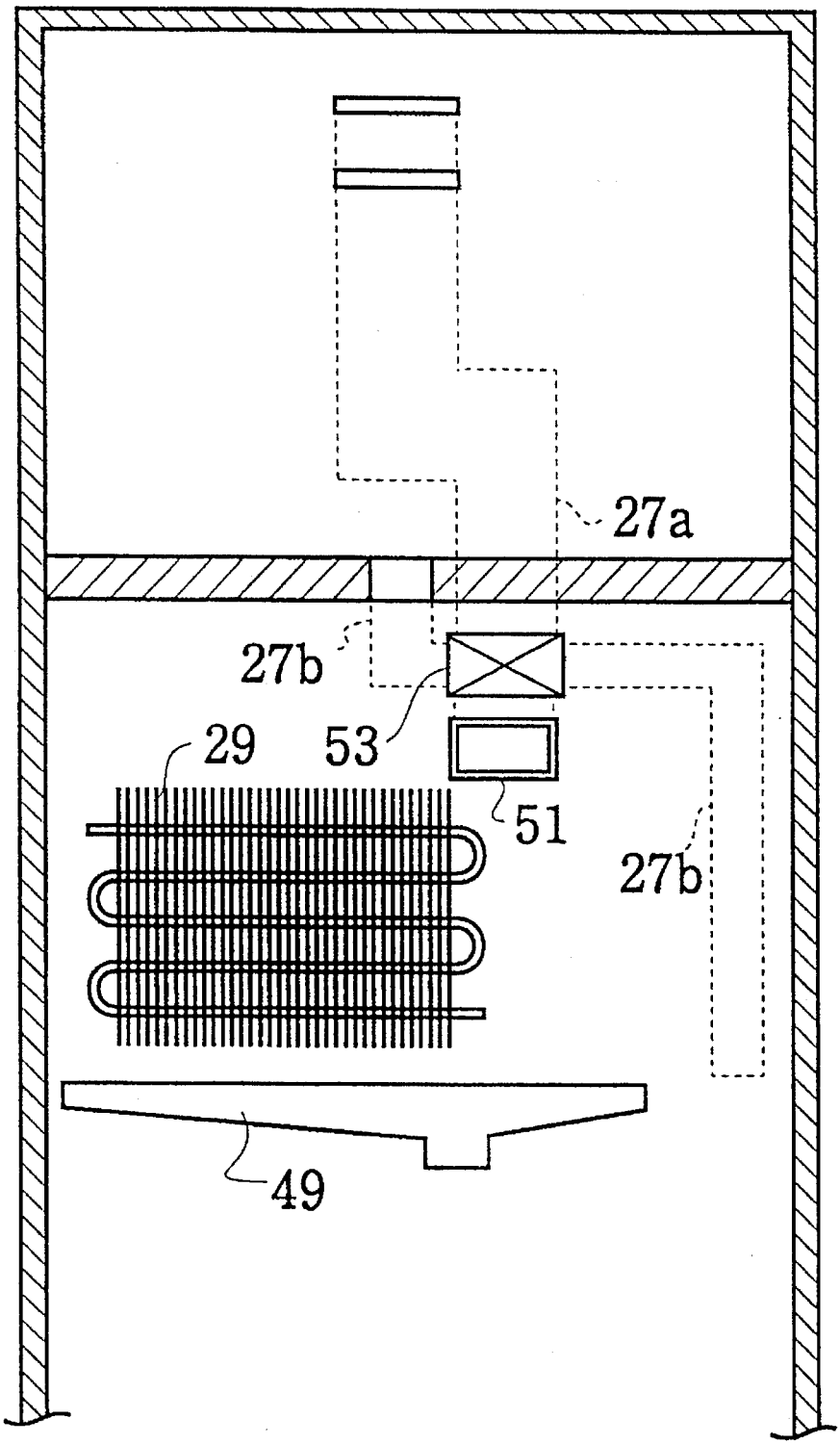
FIG. 7 illustrates a refrigerator employing a total heat exchanger as a heat exchanging means.

FIG. 7 illustrates a refrigerator employing a total heat exchanger 53 as a heat exchanging means.

Referring to FIG. 7, there is provided the total heat exchanger 53 as the heat exchanging means which heat-exchanges between the blowout duct 27*a* for blowing the cooled air into the fresh room and the discharge duct 27*b* for blowing out the cooled air from the fresh room air. The total heat exchanger 53 not only heat-exchanges between the blowout cooled air and the discharged cooled air, but also removes humidity from the cooled air discharged from the fresh room. Thus, a drain pan 49 can be made compact-sized, and the discharge duct 27*b* for discharging the air from the fresh room is unnecessarily elongated.

Moreover, the humidity taken away from the discharge duct 27*b* is guided from the blowout duct 27 into the inside of the fresh room 23, so that drying of the fresh room 23 is avoided.

Figure 8:
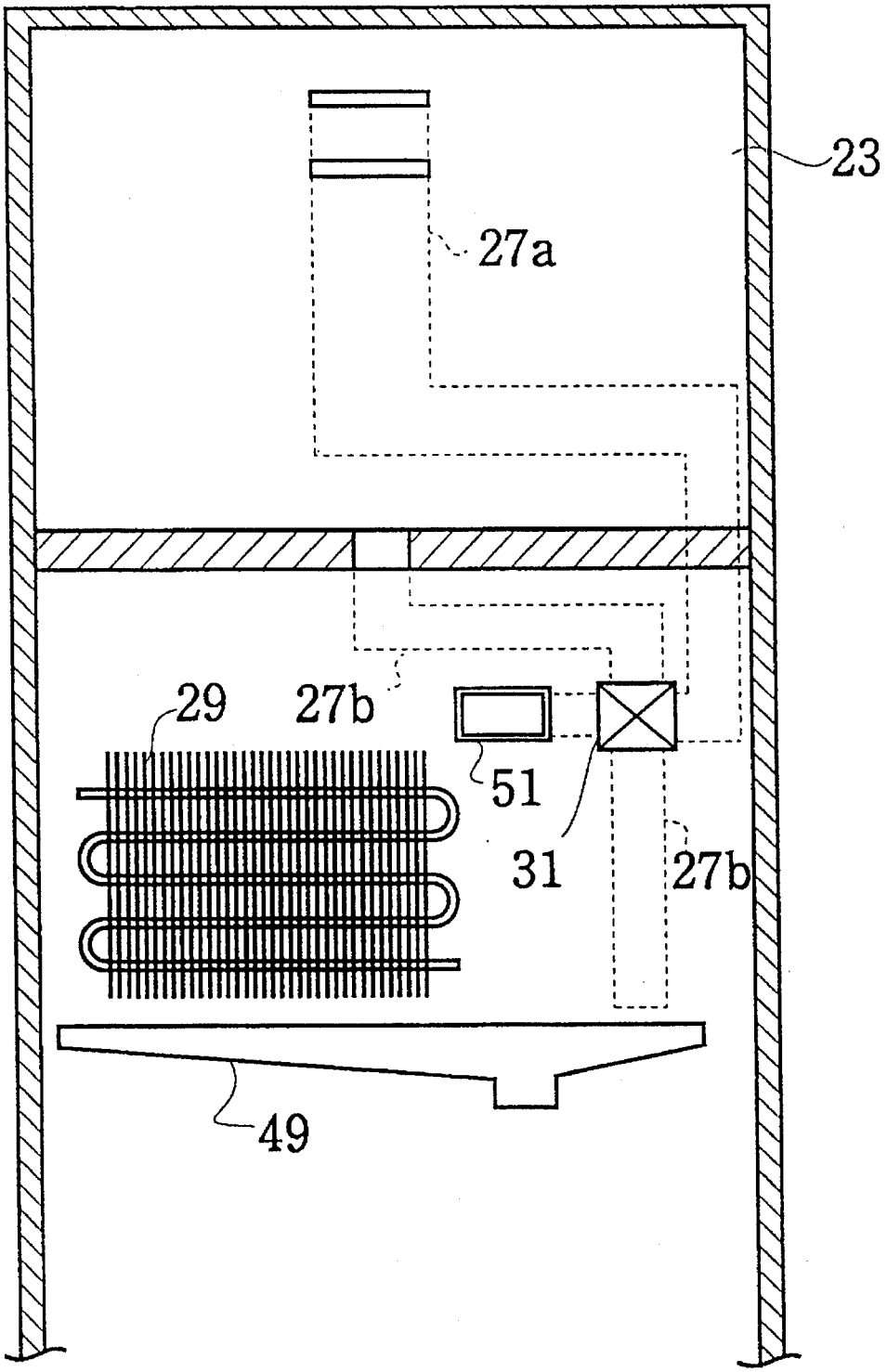
FIG. 8 is cross sectional front view of the refrigerator utilizing the novel heat-exchaging means where the discharge duct 27*b* for discharging the air from the fresh room and the drain pan 49 are elongated.

FIG. 8 is cross sectional front view of the refrigerator utilizing the novel heat-exchanging means where the discharge duct 27*b* for discharging the air from the fresh room and the drain pan 49 are elongated.

Referring to FIG. 8, there is provided the drain pan 49 below the evaporator 29, where the drain pan stores a dew drop. The elongated drain pan 49 is also located right below an end of the discharge duct 27*b* extended vertically downward from the heat exchanger 31. In FIG. 8, the reference numeral 51 indicates an intake opening that is provided for sucking air cooled by the evaporator 29 and is connected to the fresh room.

By employing the above configuration shown in FIG. 8, when the fan is stopped, a door (not shown) of the refrigerator is opened and the inside of the discharge duct 27*b* is dewed, the drain pan can receives such a discharged dew so as to safely collect the dew drop.

Though the heat exchanging means serving to heat-exchange between the blow-in air and the discharged air is provided with respect to the fresh room in the above embodiments, it shall be appreciated that the heat exchanging means may be provided in the blow-in passage and the discharged duct with respect to the vegetable room and a bottle room (which stores soft drink or the like).

It shall be appreciated that the open-close damper 33 may be an air-flow-rate adjusting means which continuously and steplessly changes the air flow rate by open degree of the damper responsive to the temperature of the fresh room.

In summary, by employing the novel refrigerator according to the present invention, the temperature at the blowout opening (or flow-in opening through which the cooled air is fed to the fresh room) is increased, while the temperature at the discharge opening (through which the cooled air is discharged from the fresh room) is decreased. As a result thereof, the temperature difference therebetween is decreased so that the the fresh room is smoothly and uniformly cooled instead of being cooled too quickly. In other words, the open duration of the damper is made longer, so that a temperature smoothing effect within the refrigerating room is optimized.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. A refrigerator including an evaporator therein, the refrigerator comprising:

a freezing room connected from the evaporator through a circulating passage, the freezing room having the circulating passage which circulates an air cooled by the evaporator;

a storage room connected to the freezing room, in which a temperature of the storage room is set higher than that of the freezing room;

a flow-in passage connected to the storage room where the air cooled by the evaporator flows into the storage room;

a flow-out passage connected from the storage room where a chilled air flows out of the storage room;

heat exchanging means for exchanging heat between the cooled air flowing through the circulating passage and the chilled air flowing through the flow-out passage; and a second storage in which a temperature thereof is set higher than that of the storage room, wherein air that is heat-exchanged in the heat exchanging means is fed to the second storage and wherein air flowing out of the second storage is fed to the evaporator.

2. A refrigerator including an evaporator therein, the refrigerator comprising:

a freezing room connected from the evaporator through a circulating passage, the freezing room having the circulating passage which circulates an air cooled by the evaporator;

a storage room connected to the freezing room, in which a temperature of the storage room is set higher than that of the freezing room;

a flow-in passage connected to the storage room where the air cooled by the evaporator flows into the storage room;

a flow-out passage connected from the storage room where a chilled air flows out of the storage room; and heat exchanging means for exchanging heat between the cooled air flowing through the circulating passage and the chilled air flowing through the flow-out passage;

wherein the heat exchanging means includes a heat pipe.

* * * * *